US010820712B2

(12) United States Patent
Huang

(10) Patent No.: US 10,820,712 B2
(45) Date of Patent: Nov. 3, 2020

(54) SELF LOCKING FOLDING BEDSTEAD

(71) Applicant: XIAMEN ROADZUP OUTDOOR PRODUCTS CO., LTD., Xiamen (CN)

(72) Inventor: Changjiu Huang, Xiamen (CN)

(73) Assignee: XIAMEN ROADZUP OUTDOOR PRODUCTS CO., LTD., Xiamen (CN)

( * ) Notice: Subject to any disclaimer, the term of this patent is extended or adjusted under 35 U.S.C. 154(b) by 225 days.

(21) Appl. No.: 16/183,242

(22) Filed: Nov. 7, 2018

(65) Prior Publication Data

US 2019/0167009 A1 Jun. 6, 2019

(30) Foreign Application Priority Data

Dec. 1, 2017 (CN) ..... 2017 1 1249421

(51) Int. Cl.
*A47C 19/12* (2006.01)
*A47C 19/14* (2006.01)
*A47C 19/02* (2006.01)

(52) U.S. Cl.
CPC ..... *A47C 19/14* (2013.01); *A47C 19/02* (2013.01); *A47C 19/126* (2013.01)

(58) Field of Classification Search
CPC ..... A47C 19/12
(Continued)

(56) References Cited

U.S. PATENT DOCUMENTS 1,608,924 A * 11/1926 Brown ..... A47B 3/02 108/118
3,956,781 A * 5/1976 Reemelin ..... A47C 17/705 5/114
(Continued)

FOREIGN PATENT DOCUMENTS

CN 201048738 Y 4/2008
CN 201332869 Y 10/2009
CN 201379302 Y 1/2010

*Primary Examiner* — Fredrick C Conley
(74) *Attorney, Agent, or Firm* — Cooper Legal Group, LLC

(57) ABSTRACT

The invention discloses a self locking folding bedstead, which comprises two transverse rods and self locking cross mechanisms. The self locking cross mechanism comprises a shearing mechanism, two second connecting rods and two third connecting rods, and the shearing mechanism comprises two first connecting rods. One end of the second connecting rod can be rotatably connected to the transverse rod, the other end can be rotatably connected to the first connecting rod, the third connecting rod can be rotatably connected to the second connecting rod, and the third connecting rod can be rotatably connected to the other first connecting rod. The shearing mechanism, two second connecting rods and two third connecting rods cooperate to form two sets of symmetrically arranged hinge four connecting rods mechanism. The self locking cross mechanism is provided with a limiting mechanism to limit the maximum angle of deployment, and the angle of the opening facing downward formed by the two third connecting rods of the self locking cross mechanism at the maximum deployment angle is greater than 180 degrees. It has the following advantages: the mechanism can be kept in the self locking state, so that the bed width and bed height are fixed, so that the bed surface can be tightened, stable and non-dumping, comfortable to use.

19 Claims, 6 Drawing Sheets

(58) Field of Classification Search
USPC ..... 5/110–114
See application file for complete search history.

(56) References Cited

U.S. PATENT DOCUMENTS

| | | | | |
|---|---|---|---|---|
| 7,661,159 | B1 | 2/2010 | Chen | |
| 8,393,023 | B2 | 3/2013 | Choi | |
| 2012/0047649 | A1 * | 3/2012 | Grace ..... | A47C 17/64<br>5/110 |

* cited by examiner

SELF LOCKING FOLDING BEDSTEAD

TECHNICAL FIELD

The invention relates to a folding bedstead, in particular to a self locking folding bedstead.

BACKGROUND TECHNIQUE

The existing folding bedstead comprises two transverse rods, a cross mechanism and a supporting rod. The cross mechanism comprises a shearing mechanism, which comprises two first connecting rods which can be rotatably connected together, and the upper ends of the two first connecting rods can be rotatably connected to the two transverse rods respectively; the upper end of the supporting rod can be rotatably connected to the transverse rod, and the lower end and the lower end of the first rod can be rotatably connected together, such as CN201332869Y, CN201048738Y issued by the Chinese Patent Database, and U.S. Pat. No. 8,393,023B2 issued by the U.S. Patent Database. Another folding bedstead is different from the previous existing folding bedstead in that: the supporting rod is slidably connected with a sliding seat, and is also provided with the second supporting rod. The upper end of the second supporting rod can be rotatably connected to the transverse rod, and the lower end can be rotatably connected to the sliding seat, such as CN201379302Y issued by the Chinese Patent Database and U.S. Pat. No. 7,661,159B1 issued by the U.S. Patent Database. It has the following shortcomings: 1. the folding bedstead limits the maximum angle of deployment through the bed fabric, and maintains the deployment state, so the fabric is easy to be damaged; 2. because the user's activity is easy to cause the bed surface fabric to change tightness, there may be slump phenomenon, uncomfortable use; 3. the folding bedstead is easy to fold at the time of unfolding, for example, the cross mechanism at both ends will accidentally fold inward during use, which is unstable and easy to shake, the use of the bed may cause accidental folding and cause dumping danger; 4. even if a manual safety lock is added to the bedstead, it will bring inconvenience to use, users will often forget to lock the safety lock after unfolding the bedstead, and forget to unlock the safety lock when folding, forcibly folding the bedstead causes damage.

SUMMARY OF THE INVENTION

The invention provides a self locking folding bedstead, which overcomes the shortcomings of the folding bedstead in the background technology.

The technical solution adopted by the invention to solve the technical problems is as follows:

a self locking folding bed frame includes two transverse rods and self locking cross mechanisms, the self locking cross mechanism comprises a shearing mechanism, which comprises two first connecting rods that can be rotatably connected together; the self locking cross mechanism also comprises two second connecting rods and two third connecting rods; one end of the second connecting rod can be rotatably connected to the transverse rod, the other end can be rotatably connected to the first connecting rod, the third connecting rod can be rotatably connected to the second connecting rod, and the third connecting rod can be rotatably connected to the other first connecting rod. The shearing mechanism, two second connecting rods and two third connecting rods cooperate to form two sets of symmetrically arranged hinge four connecting rods mechanism; the self locking cross mechanism is provided with a limiting mechanism to limit the maximum angle of deployment, and the angle of the opening facing downward formed by the two third connecting rods of the self locking cross mechanism at the maximum deployment angle is greater than 180 degrees;

In one embodiment: the first connecting rod is provided with an upper segment and a lower segment located on the upper and lower segments of the shear mechanism rotating point; the other end of the second connecting rod can be rotatably connected to the lower segment of the first connecting rod, and the third connecting rod can be rotatably connected to the upper segment of the other first connecting rod.

In one embodiment: the upper end of the second connecting rod can be rotatably connected to the transverse rod, and the lower end can be rotatably connected to the lower segment of the first connecting rod near the transverse rod.

In one embodiment: one end of the third connecting rod can be rotatably connected to the second connecting rod, and the third connecting rod can be rotatably connected to the upper segment of the first connecting rod near the transverse rod.

In one embodiment: the limiting mechanism is arranged between the first connecting rod and the third connecting rod that are rotatably connected.

In one embodiment: the limiting mechanism comprises an abutting member fixed at the other end of the third connecting rod, and the abutting member abuts against the first connecting rod from top to bottom to achieve the limit.

In one embodiment: the third connecting rod comprises two rods member, the first end of the two rods member is clamped with the second connecting rod and is provided with the first rotating shaft which pass through the two rods member and the second connecting rod to enable the two rods member and the second connecting rod to be rotatably connected together; the two rods member is clamped on both sides of the other first connecting rod and is provided with a second rotating shaft which pass through the two rods member and the other first connecting rod to enable the two rods member and the other first connecting rod to be rotatably connected together; the abutting member is fixed between the second ends of the two rods member.

In one embodiment: also comprising a support rod, the upper end of the support rod can be rotatably connected with the transverse rod, and the lower end of the first connecting rod and the lower end of the support rod can be rotatably connected.

In one embodiment: comprising at least two the self locking cross mechanisms, the end of the transverse rod is connected with one of the self locking crossing mechanisms mentioned above, and the self locking crossing mechanism connected with the end of the transverse rod is provided with two above mentioned support rods, the upper end of the support rod can be rotatably connected to the transverse rod, and the lower end is fixed with a fixed seat, and fixed seat is rotatably connected to the rotation seat, the lower end of the first connecting rod can be rotatably connected to the rotating seat.

Compared with the background technology, the technical solution has the following advantages:

the angle of the opening facing downward formed by the two third connecting rods of the self locking cross mechanism at the maximum deployment angle is greater than 180 degrees. The self locking cross mechanism is equipped with a limit mechanism to limit the maximum expansion angle, so as to prevent the angle from becoming larger and the bedstead is in the self-locking state. The mechanism can keep the self-locking state, so that the bed width is fixed and the bed height is high. The degree is also fixed, so that the bed surface reaches a tight state, stable and not dumping, more comfortable to use, the bedstead width direction of force is good, strong, and the production process is simple.

The limiting mechanism comprises an abutting member fixed at the other end of the third connecting rod, and the abutting member abuts against the first connecting rod from top to bottom to achieve the limit and the self-locking is stable and reliable.

The first end of the two rods member is clamped with the second connecting rod and is provided with the first rotating shaft which pass through the two rods member and the second connecting rod to enable the two rods member and the second connecting rod to be rotatably connected together; the two rods member is clamped on both sides of the other first connecting rod and is provided with a second rotating shaft which pass through the two rods member and the other first connecting rod to enable the two rods member and the other first connecting rod to be rotatably connected together; the abutting member is fixedly connected to the second end of the two rods member, and has the advantages of high stability, convenient processing and simple structure.

The upper end of the supporting rod can be rotatably connected to the transverse rod, the lower end of the first connecting rod and the lower end of the supporting rod can be rotatably connected to realize folding and interlocking. The self locking cross mechanism can also keep the supporting rod in the unfolding state and avoid the internal rotation of the self locking cross mechanism.

BRIEF DESCRIPTION OF THE DRAWINGS

This invention is further explained in conjunction with the accompanying drawings and embodiments.

DETAILED DESCRIPTION

Figure 1:
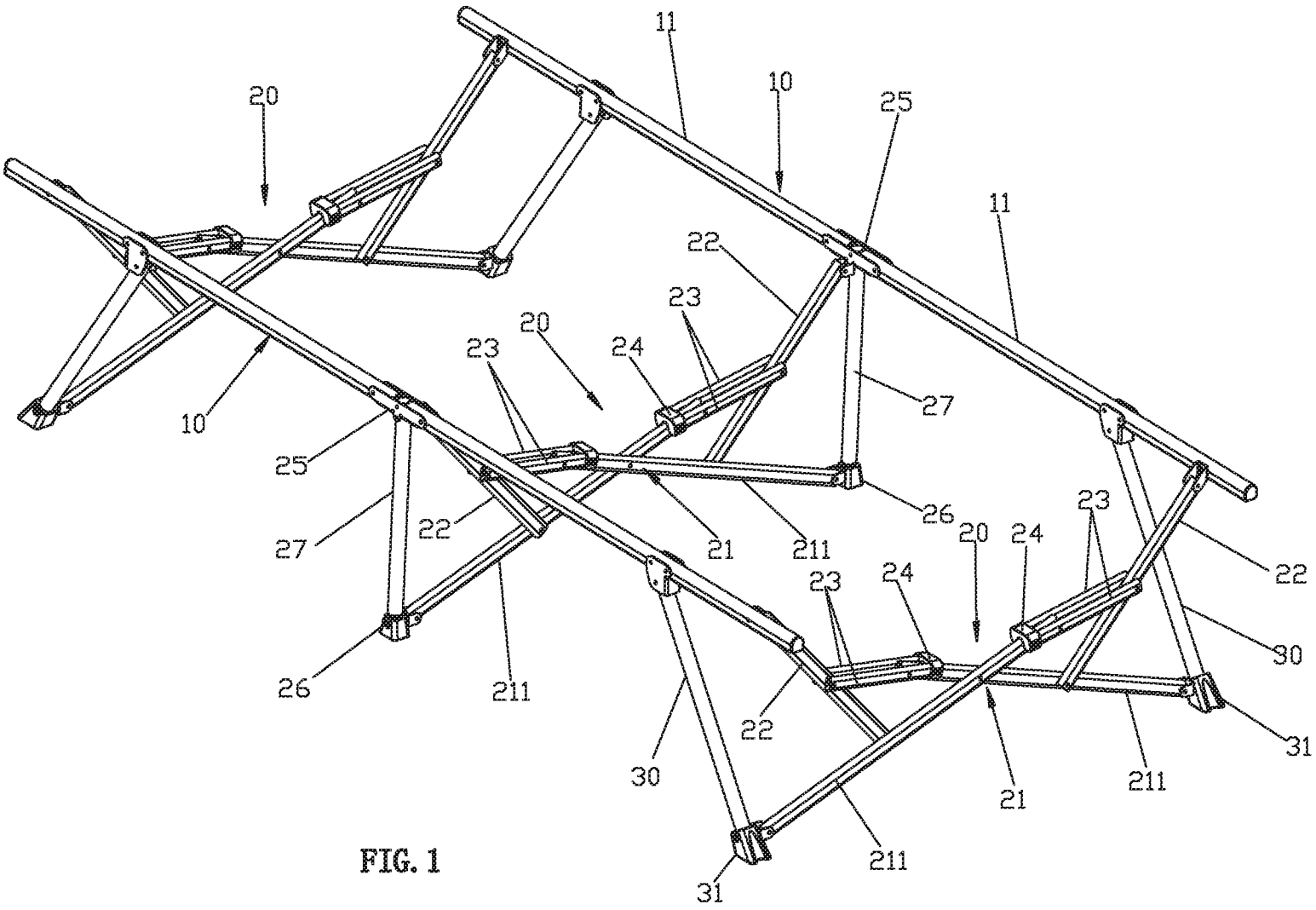
FIG. 1 is the first three-dimensional sketch diagram of the self locking folding bedstead, when the bedstead is in an unfold state.
Figure 2:
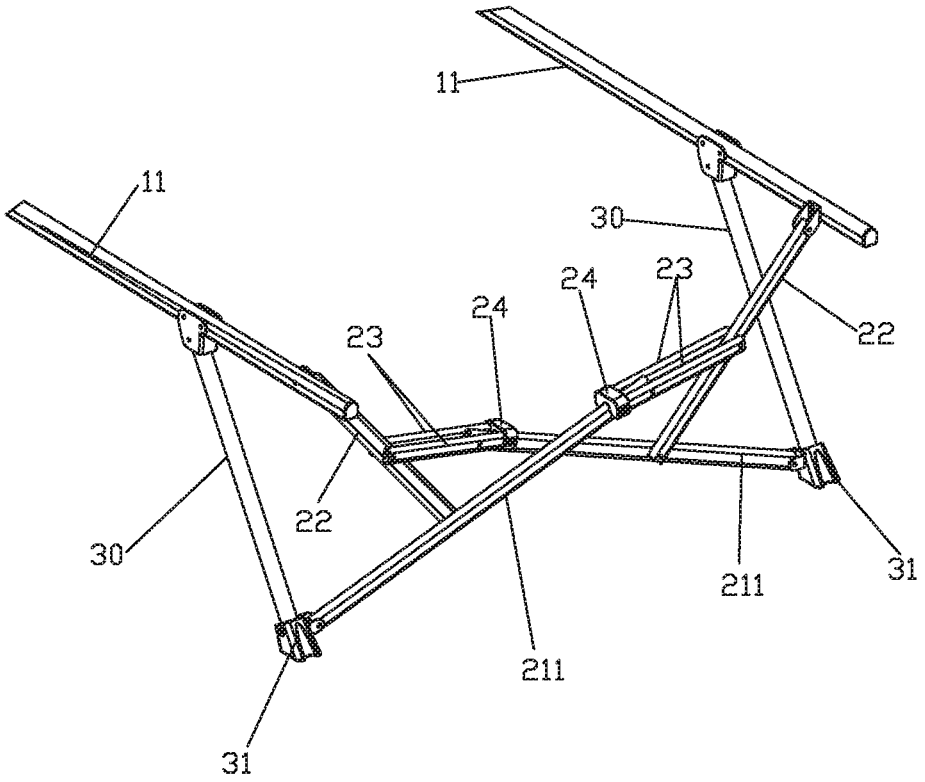
FIG. 2 is a local schematic diagram of the self locking folding bedstead.
Figure 3:
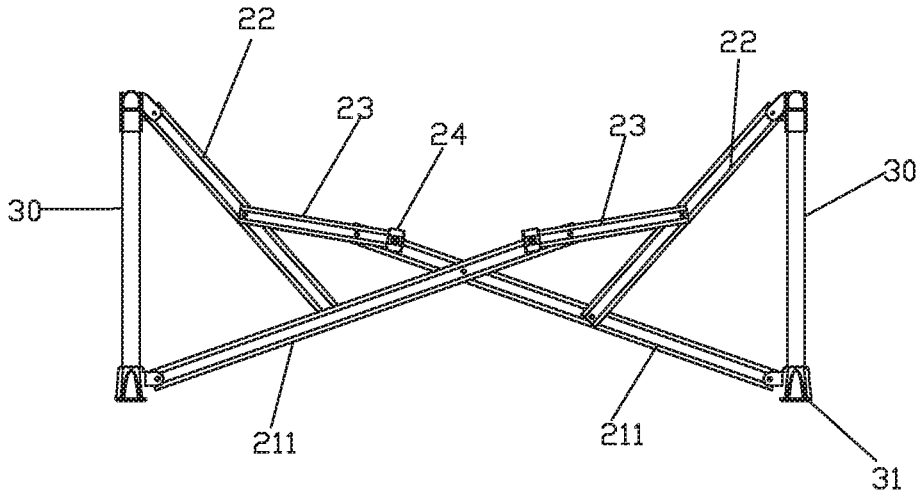
FIG. 3 is a left view sketch of the self locking folding bedstead.
Figure 4:
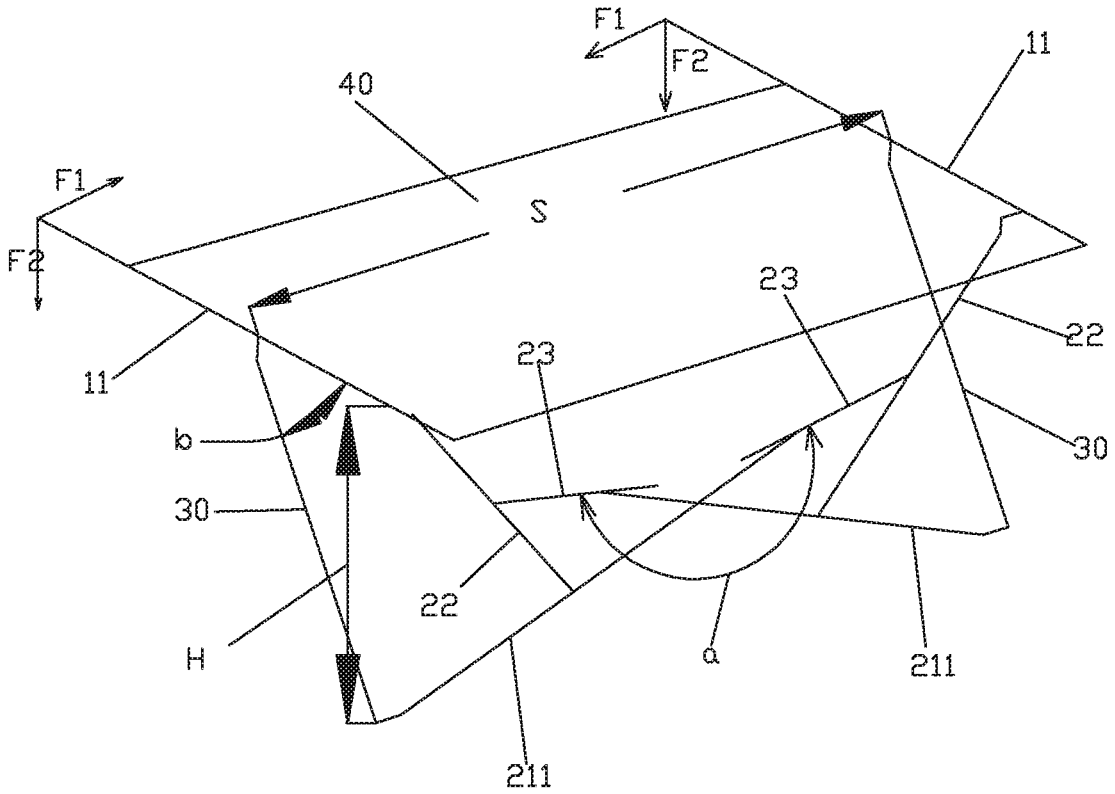
FIG. 4 is the principle schematic diagram of the self locking cross mechanism of the self locking folding bedstead.

Please refer to FIG. 1 to FIG. 8, a self locking folding bedstead, including two transverse rods 10, three self locking cross mechanisms 20 and a supporting rod 30.

The two transverse rods 10 are arranged side by side at intervals. The direction of the side by side at intervals is as shown in the left and right direction, and the following is exemplified by the left and right directions. Each of the transverse rod 10 includes two rod segments 11.

The self locking cross mechanism 20 comprises a shearing mechanism 21, two second connecting rods 22 and two third connecting rods 23. The shearing mechanism 21 includes two first connecting rods 211 which can be rotatably connected; one end of the second connecting rod 22 can be rotatably connected to the transverse rod 10, the other end can be rotatably connected to the first connecting rod 211, the third connecting rod 23 can be rotatably connected to the second connecting rod 22, and the third connecting rod 23 can be rotatably connected to the other first connecting rod 211. The shearing mechanism 21, two second connecting rods 22 and two third connecting rods 23 cooperate to form two sets of symmetrically arranged hinge four connecting rods mechanism; the self locking cross mechanism 20 is provided with a limiting mechanism 24 to limit the maximum angle of deployment, and the angle of the opening facing downward formed by the two third connecting rods 23 of the self locking cross mechanism 20 at the maximum deployment angle is greater than 180 degrees, such as 185-220 degrees, such as 195-205 degrees.

In this embodiment: the first connecting rod 211 has upper and lower segments located at the rotation point of the shearing mechanism 21, and the lower segment length is longer than the upper segment length. The upper end of the second connecting rod 22 can be rotatably connected to the transverse rod 10, and the lower end can be rotatably connected to the lower segment of the first connecting rod 211 near the transverse rod 10 (for example, the second connecting rod on the left connects the transverse rod on the left, the connect point locates in the lower segment of the first connecting rod on the left); One end of the third connecting rod 23 can be rotatably connected to the second connecting rod 22, and the third connecting rod 23 can also be rotatably connected to the upper segment of the first connecting rod 211 adjacent to the transverse rod (for example, the third connecting rod on the left connects the second connecting rod on the left and connects the upper segment of the first connecting rod on the left). The shearing mechanism 21, two second connecting rods 22 and two third connecting rods 23 cooperate to form two sets of symmetrically arranged hinge four connecting rods mechanism, such as: the upper segment of the first connecting rod on the left, the lower segment of the first connecting rod on the left, the second connecting rod on the left and the third connecting rod on the left constitute a hinge four connecting rods mechanism; the upper segment of the first connecting rod on the right, the lower segment of the first connecting rod on the right, the second connecting rod on the right and the third connecting rod on the right constitute another hinge four connecting rods mechanism.

The limiting mechanism 24 is arranged between the first connecting rod 211 and the third connecting rod 23 which are rotationally connected. The limiting mechanism 24 comprises an abutting member fixed at the other end of the third connecting rod 23, and the abutting member abuts against the first connecting rod from top to bottom to achieve the limit. In this embodiment: the third connecting rod 23 comprises two rods member, the first end of the two rods member is clamped with the second connecting rod and is provided with the first rotating shaft which pass through the two rods member and the second connecting rod to enable the two rods member and the second connecting rod to be rotatably connected together; the two rods member is clamped on both sides of the other first connecting rod and is provided with a second rotating shaft which pass through the two rods member and the other first connecting rod to enable the two rods member and the other first connecting rod to be rotatably connected together; the abutting member is fastened between the second end of the two rods member, and the bottom face of the abutting member is concavely provided with a groove adapted to the first connecting rod.

Three the self locking cross mechanism 20 are spaced along the horizontal direction of the transverse rod 10, wherein:

The self locking mechanism 20 in the middle is: the second connecting rod 22 can be rotatably connected to a connecting seat 25, the lower segment of the first connecting rod 211 is fixed with a base 26, a telescopic rod 27 is connected between the connecting seat 25 and the base 26; the first end of the two rod segment 11 of the transverse rod 10 can be rotatably connected to the connecting seat 25.

The two self locking cross mechanisms 20 on the side are: the self locking cross mechanism 20 is equipped with two aforementioned supporting rods 30, the upper end of the supporting rod 30 can be rotatably connected to the rod segment 11 of the transverse rod 10, and the lower end is fixed with a fixed seat 31. The fixed seat is rotatably connected to a rotating seat, and the lower end of the first connecting rod 211 can be rotatably connected to the rotating seat. The upper end of the second connecting rod 22 can be rotatably connected to the second end of the rod segment 11. The upper end of the supporting rod 30 can be rotatably connected to rod segment 11 between the first and second ends of the rod segment.

Wherein: the angle a of the opening facing downward formed by the two third connecting rods 23 of the self locking cross mechanism 20 at the maximum deployment angle is greater than 180 degrees, which makes the hinge four rods mechanism pass the dead point of the mechanism when the self folding state changes to the deployment state. A limiting mechanism 24 is set between the first connecting rod 211 and the third connecting rod 23 to prevent the angle a become larger. At this time, the bedstead is in the self-locking state, whether it is applying F1 or F2 mechanism it can maintain self-locking state, and the bed width S is fixed, the bed height H is fixed, and the support rod obliquity B is also fixed, so that the flexible bed surface 40 reaches the tightening state and it is stable and not easy to collapse. When folding, the lower segment of the two first connecting rod can be pressed by hand, and the folding can be unlocked.

Figure 5:
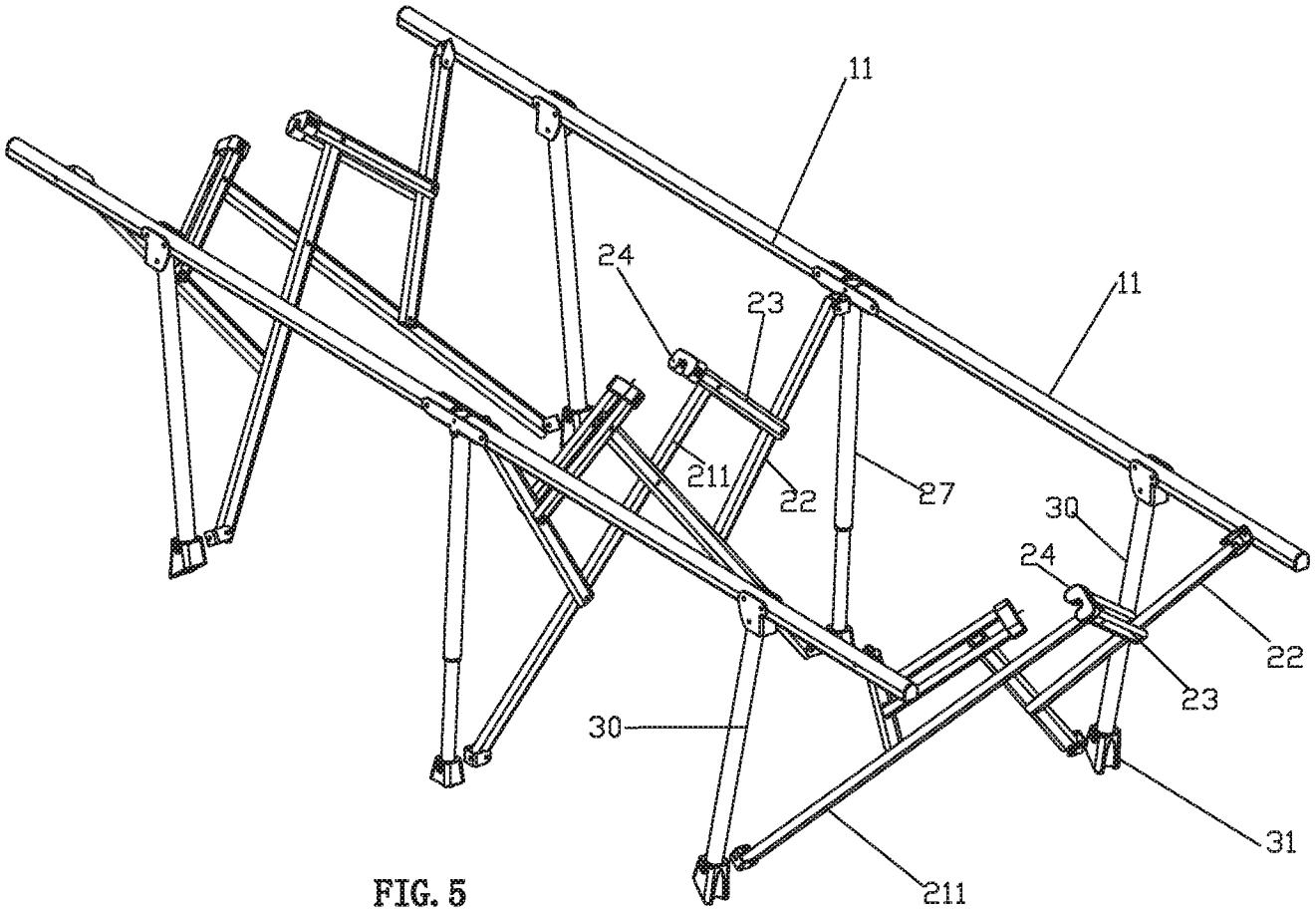
FIG. 5 is the second three-dimensional sketch diagram of the self locking folding bedstead, when the bedstead is in the first folding process.
Figure 6:
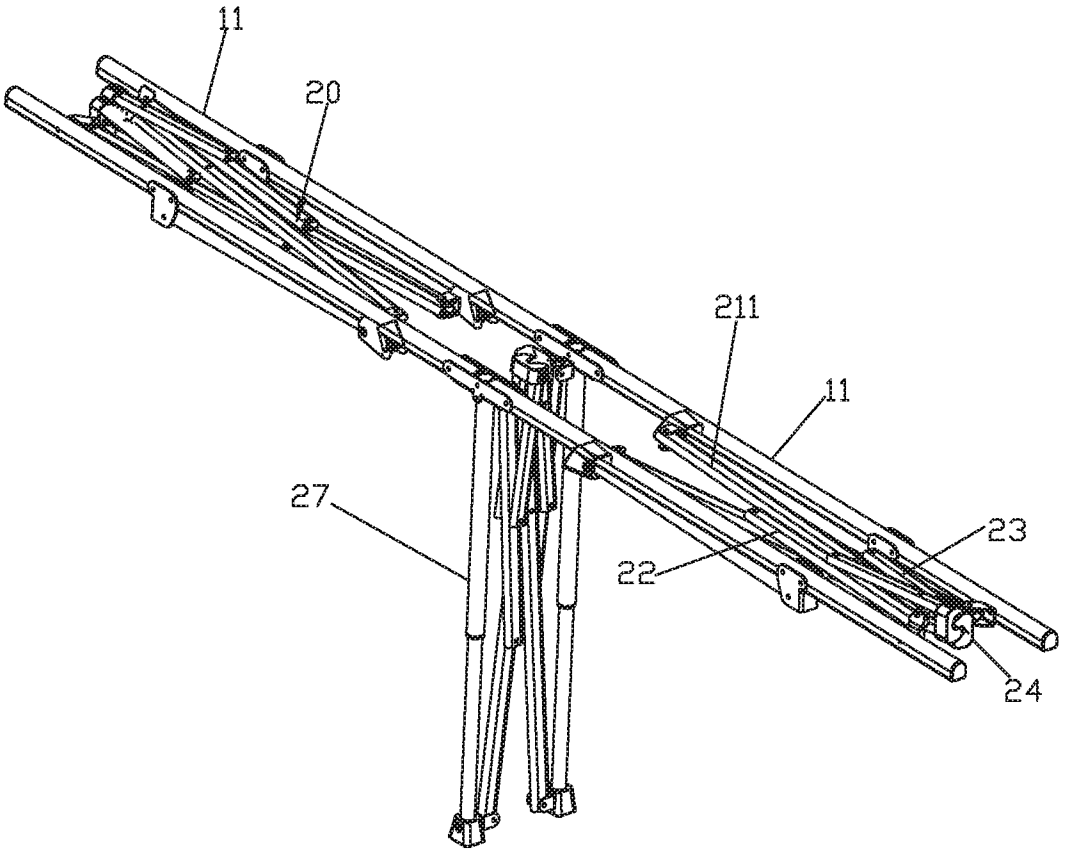
FIG. 6 is the third three-dimensional sketch diagram of the self locking folding bedstead, when the bedstead is in the second folding process.
Figure 8:
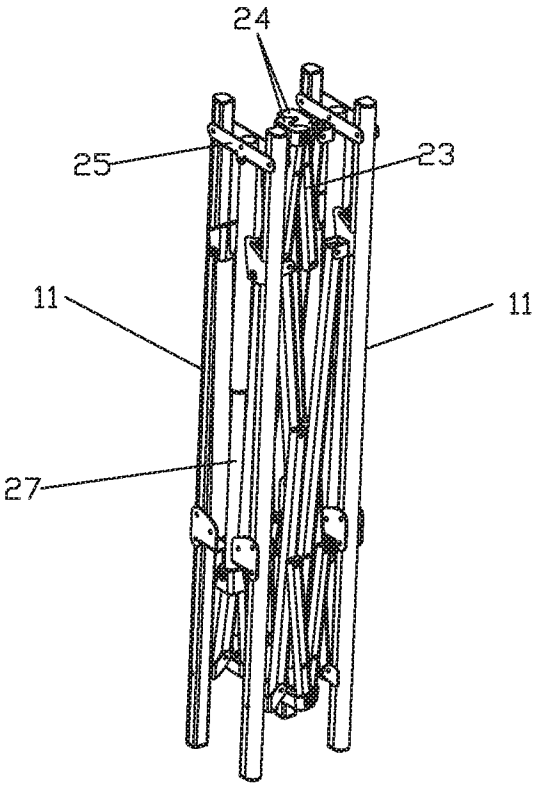
FIG. 8 is the fifth three-dimensional sketch diagram of the self locking folding bedstead, when the bedstead is in a folding state.
Figure 7:
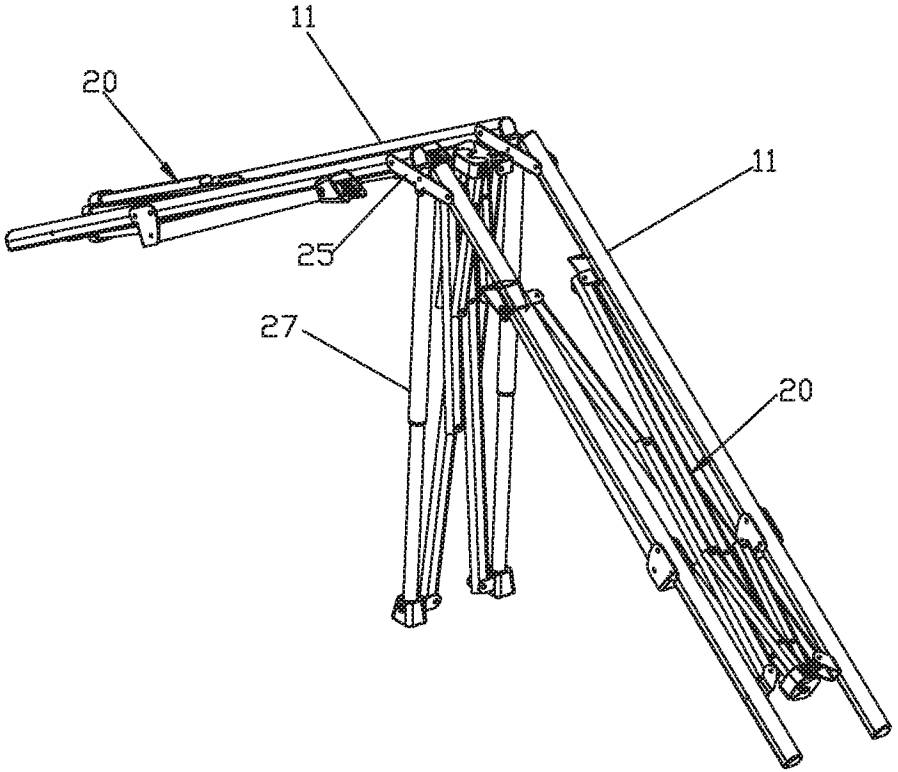
FIG. 7 is the fourth three-dimensional sketch diagram of the self locking folding bedstead, when the bedstead is in the third folding process.

At the time of folding: unlocking is achieved by pressing the lower segment of the two first connecting rods 211 by hand. The two transverse rod 10 move approximately, and the self locking cross mechanism 20 on both sides rotates toward the transverse rod 10, as shown in FIG. 5; until the two transverse rod 10 is close, the self locking cross mechanism 20 is close to the transverse rod, as shown in FIG. 6; next, the two rod segment 11 of the transverse rod 10 rotates relative to the connecting seat 25, as shown in FIG. 7; until the two rod segment 11 of the transverse rod 10 is connected to the self locking cross mechanism 20 in the middle, as shown in FIG. 8.

The above mentioned is only a better embodiment of the invention. Therefore, the scope of the invention can not be limited, that is, the equivalent changes and modifications made according to the scope and contents of the patent of the invention shall still belong to the scope covered by this invention.

The invention claimed is:

1. A self locking folding bedstead includes two transverse rods and self locking cross mechanisms, the self locking cross mechanism comprises a shearing mechanism, which comprises two first connecting rods that can be rotatably connected together; wherein: the self locking cross mechanism also comprises two second connecting rods and two third connecting rods; one end of the second connecting rod can be rotatably connected to the transverse rod, the other end can be rotatably connected to the first connecting rod, the third connecting rod can be rotatably connected to the second connecting rod, and the third connecting rod can be rotatably connected to the other first connecting rod; the shearing mechanism, two second connecting rods and two third connecting rods cooperate to form two sets of symmetrically arranged hinge four connecting rods mechanism; the self locking cross mechanism is provided with a limiting mechanism to limit the maximum angle of deployment, and the angle of the opening facing downward formed by the two third connecting rods of the self locking cross mechanism at the maximum deployment angle is greater than 180 degrees.

2. The self locking folding bedstead according to claim 1, wherein: the first connecting rod is provided with an upper segment and a lower segment located on the upper and lower segments of the shear mechanism rotating point; the other end of the second connecting rod can be rotatably connected to the lower segment of the first connecting rod, and the third connecting rod can be rotatably connected to the upper segment of the other first connecting rod.

3. The self locking folding bedstead according to claim 2, wherein: the upper end of the second connecting rod can be rotatably connected to the transverse rod, and the lower end can be rotatably connected to the lower segment of the first connecting rod near the transverse rod.

4. The self locking folding bedstead according to claim 3, wherein: one end of the third connecting rod can be rotatably connected to the second connecting rod, and the third connecting rod can be rotatably connected to the upper segment of the first connecting rod near the transverse rod.

5. The self locking folding bedstead according to claim 4, wherein: also comprising a supporting rod, the upper end of the supporting rod can be rotatably connected with the transverse rod, and the lower end of the first connecting rod and the lower end of the supporting rod can be rotatably connected.

6. The self locking folding bedstead according to claim 5, wherein: comprising at least two the self locking cross mechanisms, the end of the transverse rod is connected with one of the self locking crossing mechanisms mentioned above, and the self locking crossing mechanism connected with the end of the transverse rod is provided with two above mentioned supporting rod, the upper end of the supporting rod can be rotatably connected to the transverse rod, and the lower end is fixed with a fixed seat, and fixed seat is rotatably connected to the rotation seat, the lower end of the first connecting rod can be rotatably connected to the rotating seat.

7. The self locking folding bedstead according to claim 3, wherein: also comprising a supporting rod, the upper end of the supporting rod can be rotatably connected with the transverse rod, and the lower end of the first connecting rod and the lower end of the supporting rod can be rotatably connected.

8. The self locking folding bedstead according to claim 7, wherein: comprising at least two the self locking cross mechanisms, the end of the transverse rod is connected with one of the self locking crossing mechanisms mentioned above, and the self locking crossing mechanism connected with the end of the transverse rod is provided with two above mentioned supporting rod, the upper end of the supporting rod can be rotatably connected to the transverse rod, and the lower end is fixed with a fixed seat, and fixed seat is rotatably connected to the rotation seat, the lower end of the first connecting rod can be rotatably connected to the rotating seat.

9. The self locking folding bedstead according to claim 2, wherein: also comprising a supporting rod, the upper end of the supporting rod can be rotatably connected with the transverse rod, and the lower end of the first connecting rod and the lower end of the supporting rod can be rotatably connected.

10. The self locking folding bedstead according to claim 9, wherein: comprising at least two the self locking cross mechanisms, the end of the transverse rod is connected with one of the self locking crossing mechanisms mentioned above, and the self locking crossing mechanism connected with the end of the transverse rod is provided with two above mentioned supporting rod, the upper end of the supporting rod can be rotatably connected to the transverse rod, and the lower end is fixed with a fixed seat, and fixed seat is rotatably connected to the rotation seat, the lower end of the first connecting rod can be rotatably connected to the rotating seat.

11. The self locking folding bedstead according to claim 1, wherein: the limiting mechanism is arranged between the first connecting rod and the third connecting rod that are rotatably connected.

12. The self locking folding bedstead according to claim 11, wherein: the limiting mechanism comprises an abutting member fixed at the other end of the third connecting rod, and the abutting member abuts against the first connecting rod from top to bottom to achieve the limit.

13. The self locking folding bedstead according to claim 12, wherein: the third connecting rod comprises two rods member, the first end of the two rods member is clamped with the second connecting rod and is provided with the first rotating shaft which pass through the two rods member and the second connecting rod to enable the two rods member and the second connecting rod to be rotatably connected together; the two rods member is clamped on both sides of the other first connecting rod and is provided with a second rotating shaft which pass through the two rods member and the other first connecting rod to enable the two rods member and the other first connecting rod to be rotatably connected together; the abutting member is fixed between the second ends of the two rods member.

14. The self locking folding bedstead according to claim 12, wherein: also comprising a supporting rod, the upper end of the supporting rod can be rotatably connected with the transverse rod, and the lower end of the first connecting rod and the lower end of the supporting rod can be rotatably connected.

15. The self locking folding bedstead according to claim 14, wherein: comprising at least two the self locking cross mechanisms, the end of the transverse rod is connected with one of the self locking crossing mechanisms mentioned above, and the self locking crossing mechanism connected with the end of the transverse rod is provided with two above mentioned supporting rod, the upper end of the supporting rod can be rotatably connected to the transverse rod, and the lower end is fixed with a fixed seat, and fixed seat is rotatably connected to the rotation seat, the lower end of the first connecting rod can be rotatably connected to the rotating seat.

16. The self locking folding bedstead according to claim 11, wherein: also comprising a supporting rod, the upper end of the supporting rod can be rotatably connected with the transverse rod, and the lower end of the first connecting rod and the lower end of the supporting rod can be rotatably connected.

17. The self locking folding bedstead according to claim 16, wherein: comprising at least two the self locking cross mechanisms, the end of the transverse rod is connected with one of the self locking crossing mechanisms mentioned above, and the self locking crossing mechanism connected with the end of the transverse rod is provided with two above mentioned supporting rod, the upper end of the supporting rod can be rotatably connected to the transverse rod, and the lower end is fixed with a fixed seat, and fixed seat is rotatably connected to the rotation seat, the lower end of the first connecting rod can be rotatably connected to the rotating seat.

18. The self locking folding bedstead according to claim 1, wherein: also comprising a supporting rod, the upper end of the supporting rod can be rotatably connected with the transverse rod, and the lower end of the first connecting rod and the lower end of the supporting rod can be rotatably connected.

19. The self locking folding bedstead according to claim 18, wherein: comprising at least two the self locking cross mechanisms, the end of the transverse rod is connected with one of the self locking crossing mechanisms mentioned above, and the self locking crossing mechanism connected with the end of the transverse rod is provided with two above mentioned supporting rod, the upper end of the supporting rod can be rotatably connected to the transverse rod, and the lower end is fixed with a fixed seat, and fixed seat is rotatably connected to the rotation seat, the lower end of the first connecting rod can be rotatably connected to the rotating seat.

* * * * *